US009538605B2

(12) United States Patent
Kim et al.

(10) Patent No.: US 9,538,605 B2
(45) Date of Patent: Jan. 3, 2017

(54) CONTROL CIRCUIT OF LED LIGHTING APPARATUS

(71) Applicant: SILICON WORKS CO., LTD., Daejeon-si (KR)

(72) Inventors: Yong Geun Kim, Suwon-si (KR); Sang Young Lee, Jeonju-si (KR); Ki Chul An, Daegu-si (KR); Gyeong Sik Mun, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 0 days.

(21) Appl. No.: 14/963,444

(22) Filed: Dec. 9, 2015

(65) Prior Publication Data

US 2016/0174327 A1 Jun. 16, 2016

(30) Foreign Application Priority Data

Dec. 10, 2014 (KR) ..... 10-2014-0177812

(51) Int. Cl.
*H05B 37/02* (2006.01)
*H05B 33/08* (2006.01)

(52) U.S. Cl.
CPC ..... *H05B 33/0884* (2013.01); *H05B 33/0815* (2013.01); *H05B 33/0848* (2013.01)

(58) Field of Classification Search
CPC ..... H05B 37/02; H05B 33/08
USPC ..... 315/121, 122, 127, 128, 200 R, 185 R, 315/291, 294, 295, 299, 312
See application file for complete search history.

(56) References Cited

U.S. PATENT DOCUMENTS

| | | | | |
|---|---|---|---|---|
| 8,384,311 | B2 | 2/2013 | Gray et al. | |
| 8,598,796 | B2 | 12/2013 | Jeong | |
| 8,704,446 | B2 | 4/2014 | Gibbs | |
| 8,736,178 | B2 | 5/2014 | Lee | |
| 2010/0013411 | A1* | 1/2010 | Krespach | H05B 33/0815 315/294 |
| 2011/0199003 | A1* | 8/2011 | Muguruma | H05B 33/083 315/122 |
| 2012/0146514 | A1* | 6/2012 | Jeong | H05B 33/083 315/122 |
| 2013/0200802 | A1* | 8/2013 | Sakuragi | H05B 33/083 315/122 |
| 2015/0008836 | A1* | 1/2015 | Kim | H05B 33/0803 315/192 |

FOREIGN PATENT DOCUMENTS

| | | |
|---|---|---|
| KR | 20-0400036 | 11/2005 |
| KR | 10-2011-0016372 | 2/2011 |
| KR | 10-1043533 | 6/2011 |
| KR | 10-1160154 | 6/2012 |
| KR | 10-1175934 | 8/2012 |
| WO | 2012/078182 | 6/2012 |

* cited by examiner

*Primary Examiner* — Minh D A
(74) *Attorney, Agent, or Firm* — Kile Park Reed & Houtteman PLLC

(57) ABSTRACT

Disclosed is a control circuit of an LED lighting apparatus having a current control function. The control circuit of the LED lighting apparatus may include: a current control circuit configured to control the LED lighting apparatus divided into a plurality of LED groups, and provide a current path corresponding to sequential light emissions of the LED groups in response to a rectified voltage; and surplus voltage buffer circuits corresponding to two or more LED groups, respectively, and each configured to buffer a surplus voltage.

13 Claims, 4 Drawing Sheets

CONTROL CIRCUIT OF LED LIGHTING APPARATUS

BACKGROUND

1. Technical Field

The present disclosure relates to an LED lighting apparatus, and more particularly, to a control circuit of an LED lighting apparatus, which has a voltage buffer function.

2. Related Art

According to the recent trend of lighting technology, an LED has been employed as a light source, in order to reduce energy.

A high-brightness LED is differentiated from other light sources in terms of various aspects such as energy consumption, lifetime, and light quality.

However, a lighting apparatus using the LED as a light source requires a large number of additional circuits for current driving, because the LED is driven by a constant current.

In order to solve the above-described problem, an AC direct-type lighting apparatus has been developed.

In general, the AC direct-type LED lighting apparatus is designed to drive an LED using a rectified voltage obtained by rectifying commercial power.

Since the AC direct-type LED lighting apparatus directly uses the rectified voltage as an input voltage without using an inductor and capacitor, the AC direct-type LED lighting apparatus has a satisfactory power factor.

Each of the LEDs included in the LED lighting apparatus may be designed to operate at 2.8V or 3.8V, for example. Depending on cases, the LED lighting apparatus may be designed in such a manner that a large number of LEDs connected in series emit light using a rectified voltage.

The LED lighting apparatus may be configured in such a manner that the LEDs of each group are sequentially turned on/off according to the rise/fall of the rectified voltage.

The LED lighting apparatus may be driven in various environments. In particular, the LED lighting apparatus may be driven by a voltage higher than a design value due to the power system environment or unstable power characteristic of the region in which the LED lighting apparatus is used.

That is, the LED lighting apparatus may be driven in a state where an over voltage equal to or more than a voltage required for operating LEDs is applied. In this case, an over current may be generated by the over voltage.

The above-described over current may have an influence on a current control circuit of the LED lighting apparatus. In a severe case, internal parts may be damaged by a malfunction or thermal stress caused by heat generation. In particular, an integrated circuit chip including the current control circuit may be damaged.

Recently, the demand for an LED lighting apparatus with a large capacity has been gradually increasing. In the case of the large-capacity LED lighting apparatus, the influence of the over voltage may be intensified. Then, the lifetime of the LED lighting apparatus may be reduced or the reliability of the LED lighting apparatus may be degraded due to a malfunction and part damage.

SUMMARY

Various embodiments are directed to a control circuit of an LED lighting apparatus, which is capable of guaranteeing a stable current flow of a current control circuit for controlling LEDs, even though a voltage higher than a design value is applied due to the power system environment or an unstable power characteristic.

Also, various embodiments are directed to a control circuit of an LED lighting apparatus, which is capable of buffering a surplus voltage included in a rectified voltage even though a voltage higher than a design value is applied due to the power system environment or an unstable power characteristic.

Also, various embodiments are directed to a control circuit of an LED lighting apparatus, which is capable of absorbing a surplus voltage equal to or higher than a preset value and included in a rectified voltage outside an integrated circuit (IC) chip, even though a voltage higher than a design value is applied due to the power system environment or an unstable power characteristic, thereby preventing the heat generation by the surplus voltage in the IC chip.

In an embodiment, there is provided a control circuit of an LED lighting apparatus divided into a plurality of LED groups. The control circuit may include: a current control circuit configured to provide a current path corresponding to sequential light emissions of the LED groups in response to a rectified voltage; and surplus voltage buffer circuits corresponding to a first LED group which emits light in response to the highest light emission voltage and a second LED group which emits light in response to the second highest light emission voltage, respectively, and each configured to buffer a surplus voltage higher than the corresponding light emission voltage through voltage control.

DETAILED DESCRIPTION

Figure 1:
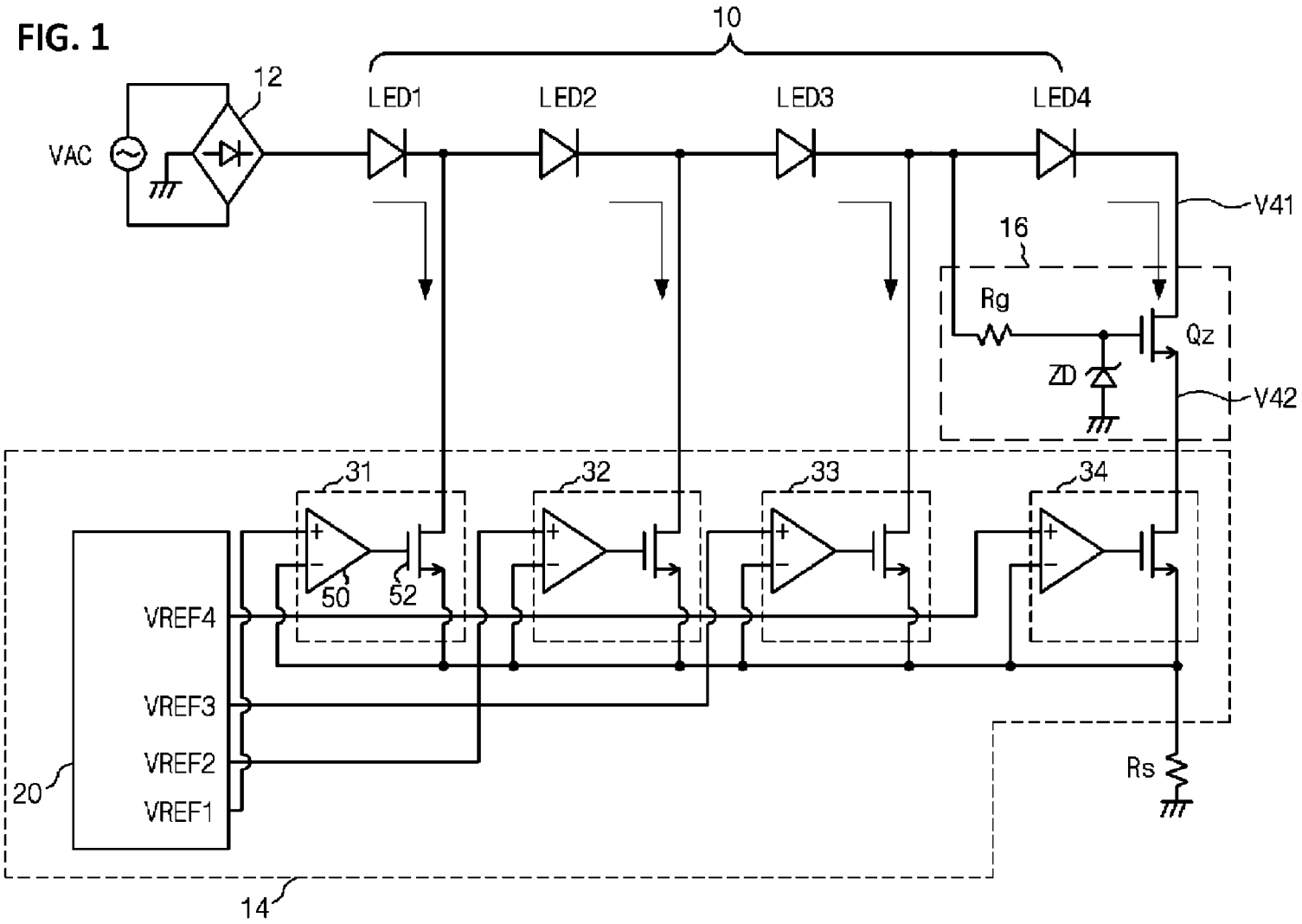
FIG. 1 is a circuit diagram illustrating a control circuit of an LED lighting apparatus in accordance with an embodiment of the present invention.

Hereafter, exemplary embodiments of the present invention will be described in detail with reference to the accompanying drawings. The terms used in the present specification and claims are not limited to typical dictionary definitions, but must be interpreted into meanings and concepts which coincide with the technical idea of the present invention.

Embodiments described in the present specification and configurations illustrated in the drawings are preferred embodiments of the present invention, and do not represent the entire technical idea of the present invention. Thus, various equivalents and modifications capable of replacing the embodiments and configurations may be provided at the point of time that the present application is filed.

The present invention provides a circuit which guarantees a stable current flow of a current control circuit even though an LED lighting apparatus is driven at a higher voltage than a design value due to the power system environment or unstable power characteristic.

In an embodiment of FIG. 1, the LED lighting apparatus emits light using a rectified voltage, and performs current regulation for light emission.

Referring to FIG. 1, the LED lighting apparatus includes a lamp 10, a power supply unit, a current control circuit 14, and a surplus voltage buffer circuit 16. The power supply unit provides a rectified voltage obtained by converting commercial power to the lamp 10, and the current control circuit 14 provides a current path for light emission to each LED group of the lamp 10.

The lamp 10 includes LEDs divided into a plurality of LED groups. The LED groups of the lamp 10 are sequentially turned on/off by the rises/falls of the rectified voltage provided from the power supply unit.

FIG. 1 illustrates that the lamp 10 includes four LED groups LED1 to LED4. Each of the LED groups LED1 to LED4 may include one or more LEDs. For convenience of description, one or more LEDs may be represented by one reference numeral.

The power supply unit is configured to rectify an AC input voltage introduced from outside and output the rectified voltage.

The power supply unit may include an AC power source VAC having an AC input voltage and a rectifier circuit 12 for rectifying the AC input voltage to output a rectified voltage.

The AC power source VAC may include a commercial power supply.

Figure 2:
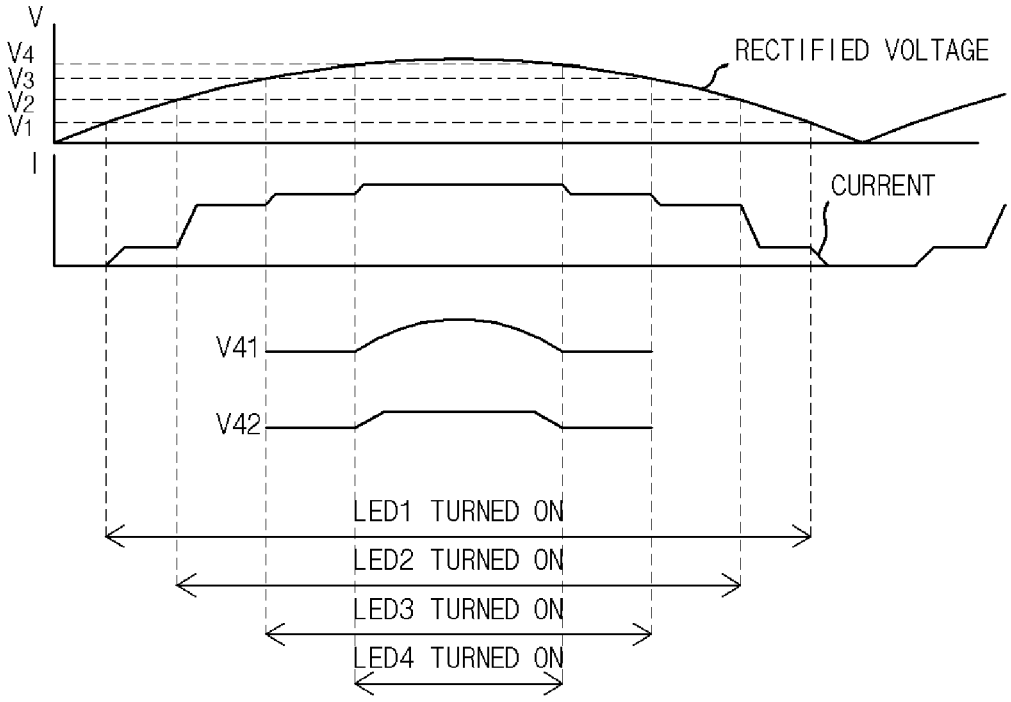
FIG. 2 is a waveform diagram for describing the operation of the embodiment of FIG. 1.

The rectifier circuit 12 full-wave rectifies a sine-wave AC input voltage of the AC power source VAC, and outputs the rectified voltage. As illustrated in FIG. 2, the rectified voltage has a ripple at which the voltage level thereof rises/falls on a basis of the half cycle of the commercial AC input voltage. In the present embodiment, the rise or fall of the rectified voltage may indicate a rise or fall of the ripple of the rectified voltage.

The current control circuit 14 performs current regulation for light emission of the LED groups LED1 to LED4.

The current control circuit 14 is configured to provide a current path for current regulation through a sensing resistor Rs of which one end is grounded.

In the embodiment of the present invention, the LED groups LED1 to LED4 of the lamp 10 are sequentially turned on or off in response to rises or falls of the rectified voltage.

When the rectified voltage rises to sequentially reach light emission voltages of the respective LED groups LED1 to LED4, the current control circuit 14 provides a current path for light emission to the respective LED groups LED1 to LED4.

The light emission voltage V4 for controlling the LED group LED4 to emit light is defined as a voltage for controlling all of the LED groups LED1 to LED4 to emit light. The light emission voltage V3 for controlling the LED group LED3 to emit light is defined as a voltage for controlling the LED groups LED1 to LED3 to emit light. The light emission voltage V2 for controlling the LED group LED2 to emit light is defined as a voltage for controlling the LED groups LED1 to LED2 to emit light. The light emission voltage V1 for controlling the LED group LED1 to emit light is defined as a voltage for controlling only the LED group LED1 to emit light.

The current control circuit 14 receives a sensing voltage through the sensing resistor Rs. The sensing voltage may be varied by a current path which is differently formed according to the light emitting states of the LED groups in the lamp 10. At this time, a current for each group, flowing through the sensing resistor Rs, may include a constant current.

The current control circuit 14 includes a plurality of switching circuits 31 to 34 and a reference voltage supply unit 20. The plurality of switching circuits 31 to 34 are configured to provide a current path for the LED groups LED1 to LED4, and the reference voltage supply unit 20 is configured to provide reference voltages VREF1 to VREF4.

The reference voltage supply unit 20 may be configured to provide the reference voltages VREF1 to VREF4 having different levels according to a designer's intention.

The reference voltage supply unit 20 may include a plurality of resistors which are connected in series to receive a constant voltage, and output the reference voltages VREF1 to VREF4 having different levels to nodes among the resistors, respectively. In another embodiment, the reference voltage supply unit 20 may include independent voltage sources for providing the reference voltages VREF1 to VREF4 having different levels.

Among the reference voltages VREF1 to VREF4 having different levels, the reference voltage VREF1 may have the lowest voltage level, and the reference voltage VREF4 may have the highest voltage level. The voltage level may gradually increase in order of the reference voltages VREF1 to VREF4.

The reference voltage VREF1 has a level for turning off the switching circuit 31 at the point of time that the LED group LED2 emits light. More specifically, the reference voltage VREF1 may be set to a lower level than the sensing voltage which is formed in the sensing resistor Rs by the light emission voltage V2 of the LED group LED2.

The reference voltage VREF2 may have a level for turning off the switching circuit 32 at the point of time that the LED group LED3 emits light. More specifically, the reference voltage VREF2 may be set to a lower level than the sensing voltage which is formed in the sensing resistor Rs by the light emission voltage V3 of the LED group LED3.

The reference voltage VREF3 may have a level for turning off the switching circuit 33 at the point of time that the LED group LED4 emits light. More specifically, the reference voltage VREF3 may be set to a lower level than the sensing voltage which is formed in the sensing resistor Rs by the light emission voltage V4 of the LED group LED4.

The reference voltage VREF4 may be set in such a manner that the current formed in the sensing resistor Rs becomes a constant current in the upper limit level region of the rectified voltage.

The switching circuits 31 to 34 are commonly connected to the sensing resistor Rs which provides a sensing voltage for performing current regulation and forming a current path.

The switching circuits 31 to 34 compare the sensing voltage of the sensing resistor Rs to the reference voltages VREF1 to VREF4 of the reference voltage supply unit 20, and form a selective current path for turning on the lamp 10.

Each of the switching circuits 31 to 34 receives a high-level reference voltage as the switching circuit is connected to an LED group away from the position to which the rectified voltage is applied.

Each of the switching circuits 31 to 34 may include a comparator 50 and a switching circuit, and the switching circuit may include an NMOS transistor 52.

The comparator 50 included in each of the switching circuits 31 to 34 has a positive input terminal (+) configured to receive a reference voltage, a negative input terminal (−) configured to receive a sensing voltage, and an output terminal configured to output a result obtained by comparing the reference voltage and the sensing voltage.

The NMOS transistor 52 included in each of the switching circuits 31 to 34 may perform a switching operation according to an output of the comparator 50, which is applied to the gate thereof.

The surplus voltage buffer circuit 16 may be provided outside an integrated circuit (IC) chip including the current control circuit 14, and configured in series on the current path of the LED group LED4 which finally emits light. The LED group LED4 which finally emits light receives the highest rectified voltage.

According to the above-described configuration, the surplus voltage buffer circuit 16 controls a surplus voltage included in an output voltage of the LED group LED4, and limits a current flow from the LED group LED4 to the current control circuit 14.

That is, the surplus voltage buffer circuit 16 may be connected in series on the current path of the LED group LED4, and perform voltage buffering in response to a surplus voltage caused by an over-voltage state of the rectified voltage, in order to control an over current flowing to the current control circuit 14. In order to perform voltage buffering, the surplus voltage buffer circuit 16 may absorb a surplus voltage through voltage distribution.

Furthermore, the surplus voltage buffer circuit 16 may be connected in series on the current path of the LED group LED4, and buffer the voltage supplied to the current control circuit 14 by absorbing a surplus voltage contained in an output voltage of the LED group LED4, corresponding to a rectified voltage in an over-voltage state, the surplus voltage being equal to or more than a preset value.

The surplus voltage buffer circuit 16 may include a surplus voltage detection unit and a switching unit. The surplus voltage detection unit may provide a detection voltage having a constant voltage period in response to a change of the rectified voltage, and the switching unit may perform current control between the current control circuit 14 and the LED group LED4 which finally emits light, according to the detection voltage, and absorb the surplus voltage.

The switching unit included in the surplus voltage buffer circuit 16 may include a power FET (hereafter, referred to as transistor Qz) which controls a current flow according to the detection voltage.

The surplus voltage detection unit may include a detection resistor Rg and a Zener diode ZD which are connected in parallel to the LED group LED4. The detection voltage indicates a voltage applied to a node between the detection resistor Rg and the Zener diode ZD, and is applied to the gate of the transistor Qz serving as the switching unit. The Zener diode ZD serves as a constant voltage source which stabilizes the voltage of the gate of the switching unit of the surplus voltage buffer circuit 16 by limiting the detection voltage applied to the gate to a predetermined value.

Thus, when the voltage applied to the Zener diode ZD through the detection resistor Rg is equal to or lower than the voltage limited by the Zener diode ZD, the detection voltage follows the change of the rectified voltage. However, when the voltage applied to the Zener diode ZD through the detection resistor Rg is higher than the voltage limited by the Zener diode ZD, the detection voltage has a constant voltage through the Zener diode ZD. That is, the detection voltage has a constant voltage period and a period in which the detection voltage follows the change of the rectified voltage in response to the change of the rectified voltage. At this time, the Zener diode ZD may be configured to have a breakdown voltage of 3V to 50V.

As described above, the surplus voltage buffer circuit 16 is configured between the LED group LED4 and the NMOS transistor 52 of the switching circuit 34 of the current control circuit 14, and absorbs a surplus voltage through the operation of the transistor Qz, thereby guaranteeing a normal current flow while normally applying a voltage to the switching circuit 34.

Now, the operation of the LED lighting apparatus in a state where a normal rectified voltage is applied will be described with reference to FIG. 2.

When the rectified voltage is in the initial state, all of the switching circuits 31 to 34 maintain a turn-on state because the reference voltages VREF1 to VREF4 applied to the positive input terminals (+) thereof are higher than the sensing voltage of the resistor Rs, which is applied to the negative input terminals (−) thereof.

Then, when the rectified voltage rises to reach the light emission voltage V1, the LED group LED1 of the lamp 10 emits light. When the LED group LED1 of the lamp 10 emits light, the switching circuit 31 of the current control circuit 14, connected to the LED group LED1, provides a current path.

When the rectified voltage reaches the light emission voltage V1 such that the LED group LED1 emits light and the current path is formed through the switching circuit 31, the level of the sensing voltage of the sensing resistor Rs rises. However, since the level of the sensing voltage is low, the turn-on states of the switching circuits 31 to 34 are not changed.

Then, when the rectified voltage continuously rises to reach the light emission voltage V2, the LED group LED2 of the lamp 10 emits light. When the LED group LED2 of the lamp 10 emits light, the switching circuit 32 of the current control circuit 14, connected to the LED group LED2, provides a current path. At this time, the LED group LED1 also maintains the light emitting state.

When the rectified voltage reaches the light emission voltage V2 such that the LED group LED2 emits light and the current path is formed through the switching circuit 32, the level of the sensing voltage of the sensing resistor Rs rises. At this time, the sensing voltage has a higher level than the reference voltage VREF1. Therefore, the NMOS transistor 52 of the switching circuit 31 is turned off by the output of the comparator 50. That is, the switching circuit 31 is turned off, and the switching circuit 32 provides a selective current path corresponding to the light emission of the LED group LED2.

Then, when the rectified voltage continuously rises to reach the light emission voltage V3, the LED group LED3 of the lamp 10 emits light. When the LED group LED3 of the lamp 10 emits light, the switching circuit 33 of the current control circuit 14, connected to the LED group LED3, provides a current path. At this time, the LED groups LED1 and LED2 also maintain the light emitting state.

When the rectified voltage reaches the light emission voltage V3 such that the LED group LED3 emits light and the current path is formed through the switching circuit 33, the level of the sensing voltage of the sensing resistor Rs rises. At this time, the sensing voltage has a higher level than the reference voltage VREF2. Therefore, the NMOS transistor 52 of the switching circuit 32 is turned off by the output of the comparator 50. That is, the switching circuit 32 is turned off, and the switching circuit 33 provides a selective current path corresponding to the light emission of the LED group LED3.

Then, when the rectified voltage continuously rises to reach the light emission voltage V4, the LED group LED4 of the lamp 10 emits light. When the LED group LED4 of the lamp 10 emits light, the switching circuit 34 of the current control circuit 14, connected to the LED group LED4, provides a current path. At this time, the LED groups LED1 to LED3 also maintain the light emitting state.

When the rectified voltage reaches the light emission voltage V4 such that the LED group LED4 emits light and the current path is formed through the switching circuit 34, the level of the sensing voltage of the sensing resistor Rs rises. At this time, the sensing voltage has a higher level than the reference voltage VREF3. Therefore, the NMOS transistor 52 of the switching circuit 33 is turned off by the output of the comparator 50. That is, the switching circuit 33 is turned off, and the switching circuit 34 provides a selective current path corresponding to the light emission of the LED group LED4.

Then, although the rectified voltage continuously rises, the switching circuit 34 maintains the turn-on state such that the current formed in the sensing resistor Rs becomes a constant current in the upper limit level region of the rectified voltage.

When the LED groups LED1 to LED4 sequentially emit light in response to the rises of the rectified voltage, the current of the current path, corresponding to the light emitting state, increases in a stepwise manner as illustrated in FIG. 2. That is, since the current control circuit 14 performs a constant current regulation operation, the current corresponding to light emission of each LED group maintains a constant level. When the number of LED groups to emit light increases, the level of the current on the current path increases in response to the increase in number of LED groups.

After the rectified voltage rises to the upper limit level as described above, the rectified voltage starts to fall.

When the rectified voltage falls below the light emission voltage V4, the LED group LED4 of the lamp 10 is turned off.

When the LED group LED4 is turned off, the lamp 10 maintains the light emitting state using the LED groups LED3, LED2, and LED1. Thus, a current path is formed by the switching circuit 33 connected to the LED group LED3.

Then, when the rectified voltage sequentially falls below the light emission voltages V3, V2, and V1, the LED groups LED3, LED2, and LED1 of the lamp 10 are sequentially turned off.

As the LED groups LED3, LED2, and LED1 of the lamp 10 are sequentially turned off, the current control circuit 14 shifts and provides a selective current path formed by the switching circuits 33, 32, and 31. Furthermore, in response to the turn-off states of the LED groups LED1 to LED4, the level of the current on the current path also decreases in a stepwise manner.

In the present embodiment, the LED groups may be sequentially turned on/off in a normal environment, and an LED may emit light using a voltage higher than a design value due to the power system environment or an unstable power characteristic. Hereafter, the voltage is referred to as an over voltage.

Each of the LED groups may be driven by an over voltage higher than the corresponding light emission voltage. The rectified voltage corresponding to the over voltage includes a surplus voltage equal to or more than a preset value higher than the light emission voltage.

In the embodiment of the present invention, suppose that an effective value of the ripple of the rectified voltage is designed to 220V. In this case, the maximum value of the waveform of the rectified voltage in the over-voltage state may rises over 250V.

Thus, when the rectified voltage in the over-voltage state gradually rises, the LED groups LED1 to LED4 sequentially emit light according to the level of the rectified voltage.

Even when the LED group LED4 finally emits light, the rectified voltage in the over-voltage state may rise over the design value which is set to drive the LED group LED4, that is, 220V.

The change of the rectified voltage applied to the LED group LED4 is detected by the detection resistor Rg and transmitted as a reverse bias voltage of the Zener diode ZD.

The breakdown voltage of the Zener diode ZD may be set in the range of 3V to 50V, and the Zener diode ZD guarantees a normal turn-on state of the transistor Qz until the voltage transmitted through the detection resistor Rg reaches the breakdown voltage of the Zener diode ZD.

When the rectified voltage applied to the LED group LED4 enters the over-voltage state such that the voltage transmitted to the Zener diode ZD exceeds the breakdown voltage of the Zener diode ZD, the detection voltage enters the constant voltage period in which a constant voltage is maintained through the constant voltage operation of the Zener diode ZD, and the gate voltage of the transistor Qz does not increase any more. At this time, the output voltage V41 of the LED group LED4 of FIG. 2 may be controlled by the transistor Qz, and the voltage applied to the switching circuit 34 may be represented by V42. The voltage V41 is an output voltage of the LED group LED4, and corresponds to a value obtained by subtracting the sum of the light emission voltages of the LED groups LED1 to LED4 from the rectified voltage.

That is, although the output voltage V41 of the LED group LED4 increases, the Zener diode ZD applies the detection voltage limited to a constant level to the gate of the transistor Qz. As a result, the detection voltage maintaining the constant level is applied to the gate of the transistor Qz, and increases the source-drain voltage.

More specifically, when the detection voltage limited by the Zener diode ZD is applied to the gate of the transistor Qz, the current of the transistor Qz is not increased any more, but constantly maintained. Thus, a voltage corresponding to an increase of the surplus voltage included in the output voltage V41 of the LED group LED4 of FIG. 2 is applied between the source and drain of the transistor Qz. As a result, the transistor Qz absorbs the surplus voltage. As the surplus voltage is absorbed between the source and drain of the transistor Qz, the level of the voltage V42 applied to the switching circuit 34 is controlled. Thus, an over voltage can be prevented from being applied to the switching circuit 34 of the current control circuit 14 forming a current path for the LED group LED4 which finally emits light.

When the rectified voltage applied to the LED group LED4 which finally emits light rises to an over voltage equal to or more than the preset value, the surplus voltage buffer circuit 16 buffers the surplus voltage to guarantee a normal operation of the current control circuit 14.

Thus, the surplus voltage caused by the rectified voltage in the over-voltage state can be prevented from being applied to the IC chip including the current control circuit 14, and the surplus voltage included in the rectified voltage in the over-voltage state may be absorbed and buffered outside the IC chip.

In consideration of heat generated by the surplus voltage, the transistor Qz may include a power FET (Field Effect Transistor) capable of performing a stable operation even though heat is generated.

Figure 3:
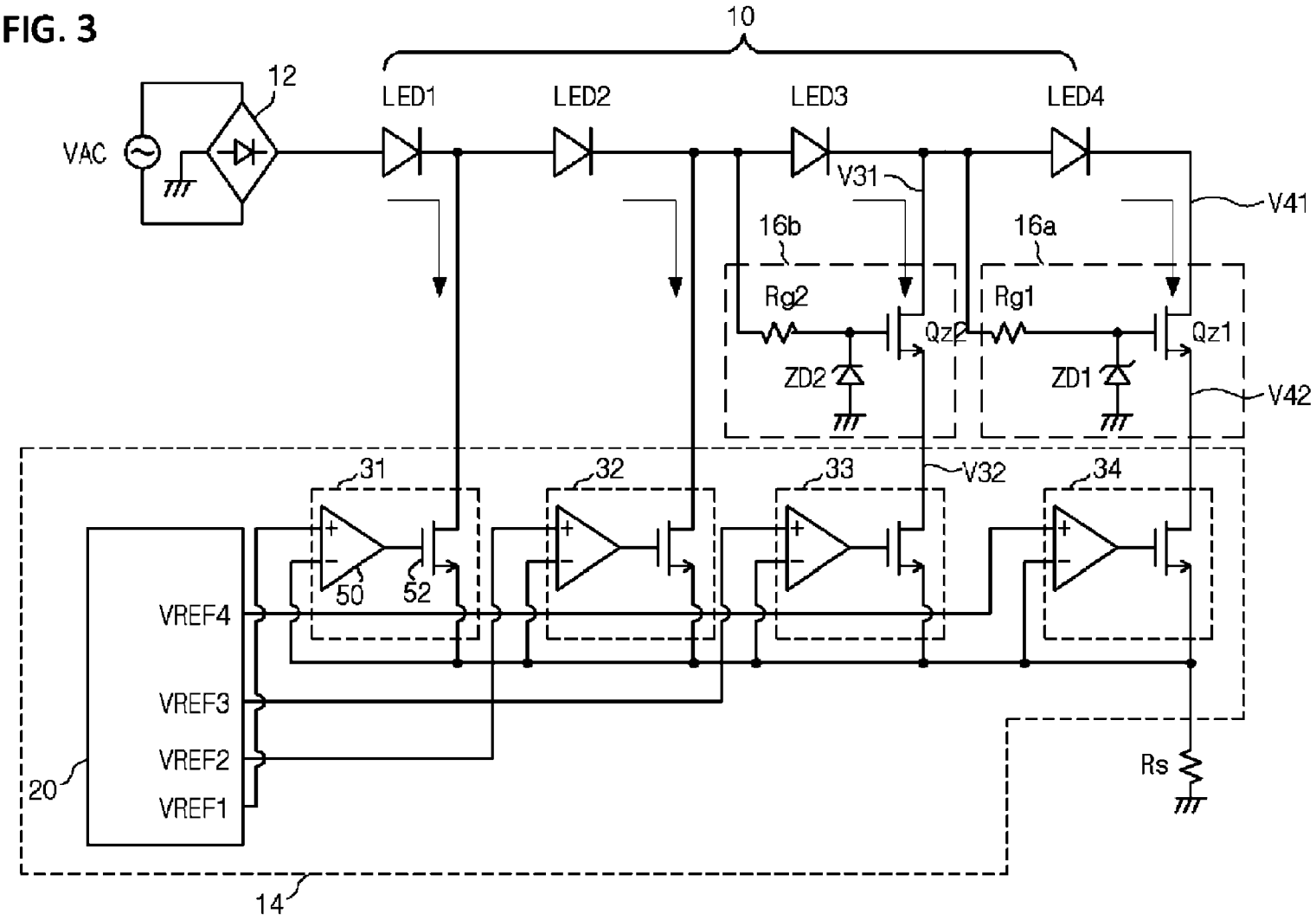
FIG. 3 is a circuit diagram illustrating a control circuit of an LED lighting apparatus in accordance with another embodiment of the present invention.

In another embodiment, the LED lighting apparatus may include surplus voltage buffer circuits 16*a* and 16*b* as illustrated in FIG. 3.

The surplus voltage buffer circuits 16*a* and 16*b* are configured to correspond to the LED groups LED4 which emits light in response to the highest light emission voltage and the LED group LED3 which emits light in response to the second highest light emission voltage. When a surplus voltage higher than the light emission voltages occurs, the surplus voltage buffer circuits 16*a* and 16*b* buffer the surplus voltage through voltage control. The voltage control for the surplus voltage buffering operation by the surplus voltage buffer circuits 16*a* and 16*b* may include voltage absorption.

The surplus voltage buffer circuits 16*a* and 16*b* may be provided outside the IC chip including the current control circuit 14. The surplus voltage buffer circuit 16*a* may be configured in series to the current path of the LED group LED4 which finally emits light in response to the highest light emission voltage, and the surplus voltage buffer circuit 16*b* may be configured in series to the current path of the LED group LED3 which emits light in response to the second highest light emission voltage.

FIG. 3 illustrates that the surplus voltage buffer circuits are applied to the LED groups LED3 and LED4. However, the present invention is not limited thereto, but the surplus voltage buffer circuits can also be applied to the LED groups LED1 and LED2 in consideration of the level of the rectified voltage and the heat generation of the IC chip including the current control circuit 14.

According to the above-described configuration, when an over voltage is applied, the surplus voltage buffer circuits 16*a* and 16*b* control surplus voltages included in output voltages of the LED groups LED3 and LED4, limit currents flowing from the LED groups LED3 and LED4 to the current control circuit 14, and absorb the surplus voltages.

That is, as described with reference to FIGS. 1 and 2, the surplus voltage buffer circuit 16*a* may be configured in series to the current path of the LED group LED4, and buffer a surplus voltage included in an output voltage of the LED group LED4 corresponding to the rectified voltage in an over-voltage state, thereby preventing an over current from flowing to the current control circuit 14.

Furthermore, as described with reference to FIG. 3, the surplus voltage buffer circuit 16*b* may be configured in series to the current path of the LED group LED3, and buffer a surplus voltage included in an output voltage of the LED group LED3 while the turn-on state of the switching circuit 33 is maintained to form a current path, thereby preventing an over current from flowing to the current control circuit 14.

Since the surplus voltage buffer circuit 16*a* of the surplus voltage buffer circuits 16*a* and 16*b* is configured and operated in the same manner as the embodiment of FIGS. 1 and 2, the duplicated descriptions thereof are omitted herein. The Zener diode, the transistor, and the detection resistor, which are included in the surplus voltage buffer circuit 16*a*, are represented by ZD1, Qz1, and Rg1 to distinguish from those of FIGS. 1 and 2.

The surplus voltage buffer circuit 16*b* may include a surplus voltage detection unit and a switching unit, like the surplus voltage buffer circuit 16*a*. The surplus voltage detection unit may provide a detection voltage having a constant voltage period in response to a change of the rectified voltage, and the switching unit may absorb a surplus voltage while performing current control between the LED group LED3 and the current control circuit 14, according to the detection voltage.

The switching unit included in the surplus voltage buffer circuit 16*b* may include a power FET (hereafter, referred to as transistor Qz2) which controls a current flow according to the detection voltage.

The surplus voltage detection unit may include a detection resistor Rg2 and a Zener diode ZD2 which are connected in parallel to the LED group LED3. The detection voltage indicates a voltage applied to a node between the detection resistor Rg2 and the Zener diode ZD2, and is applied to the gate of the transistor Qz2 serving as the switching unit. While the turn-on state of the switching circuit 33 is maintained to form a current path, the Zener diode ZD2 serves as a constant voltage source which stabilizes the voltage of the gate by limiting the voltage applied to the gate of the switching unit of the surplus voltage buffer circuit 16*b* to a predetermined value.

Thus, when the voltage applied to the Zener diode ZD2 through the detection resistor Rg2 is equal to or lower than the voltage limited by the Zener diode ZD2 while the turn-on state of the switching circuit 33 is maintained to form the current path, the detection voltage follows the change of the rectified voltage. Thus, when the voltage applied to the Zener diode ZD2 through the detection resistor Rg2 is higher than the voltage limited by the Zener diode ZD2 while the turn-on state of the switching circuit 33 is maintained to form the current path, the detection voltage has a constant voltage through the Zener diode ZD2.

Then, when the rectified voltage rises over the light emission voltage of the LED group LED4, no current path is formed by the switching circuit 33 connected to the transistor Qz2. At this time, the voltage applied to the switching circuit 33 follows the waveform of the output voltage V31 of the LED group LED3.

As described above, the detection voltage applied to the gate of the transistor Q3 connected to the LED group LED3 has the constant voltage period and the period in which the detection voltage follows the change of the rectified voltage in response to the change of the rectified voltage while the turn-on state of the switching circuit 33 is maintained to form the current path.

At this time, the Zener diode ZD2 may be configured to have a breakdown voltage of 3V to 50V.

According to the above-described configuration, the surplus voltage buffer circuit 16*b* is configured between the LED group LED3 and the NMOS transistor 52 of the switching circuit 33 of the current control circuit 14, and absorbs a surplus voltage included in the output voltage V31 of the LED group LED3, while the turn-on state of the switching circuit 33 is maintained to form the current path.

When the rectified voltage rises over the light emission voltage V3 of the LED group LED3, the Zener diode ZD2 guarantees a normal turn-on state of the transistor Qz until the voltage transmitted through the detection resistor Rg2 reaches the breakdown voltage of the Zener diode ZD2.

Then, when the rectified voltage applied to the LED group LED3 exceeds the breakdown voltage of the Zener diode ZD2, the Zener diode ZD2 limits the detection voltage applied to the gate of the transistor Qz2 such that the detection voltage is constantly maintained. At this time, the transistor Qz2 absorbs the surplus voltage included in the output voltage V31 of the LED group LED3. As the transistor Qz2 absorbs the surplus voltage, the voltage applied to the switching circuit 33, represented by V32, may retain a constant level. The output voltage V31 of the LED group LED3 may correspond to a value obtained by subtracting the sum of the light emission voltages of the LED groups LED1 to LED3 from the rectified voltage.

That is, while the turn-on state of the switching circuit 33 is maintained to form the current path, the detection voltage limited to a constant level is applied to the gate of the transistor Qz2 and the source-drain voltage of the transistor Qz2 is increased, even though the rectified voltage rises.

More specifically, when the detection voltage limited by the Zener diode ZD2 is applied to the gate of the transistor Qz2 while the turn-on state of the switching circuit 33 is maintained to form the current path, the current of the transistor Qz2 is not increased any more, but constantly maintained. Thus, a voltage corresponding to an increase of the surplus voltage included in the output voltage of the LED group LED3 is applied between the source and drain of the transistor Qz2. As a result, the transistor Qz2 absorbs the surplus voltage. As the surplus voltage is absorbed between the source and drain of the transistor Qz2, the voltage V32 of which the voltage level is controlled may be transmitted to the switching circuit 33, and an over voltage may be prevented from being applied to the switching circuit 33 which forms the current path for the LED group LED3.

While the turn-on state of the switching circuit 33 is maintained to the form the current path, the surplus voltage buffer circuit 16*b* buffers the surplus voltage included in the output voltage of the LED group LED3, thereby guaranteeing a normal operation of the current control circuit 14.

Figure 4:
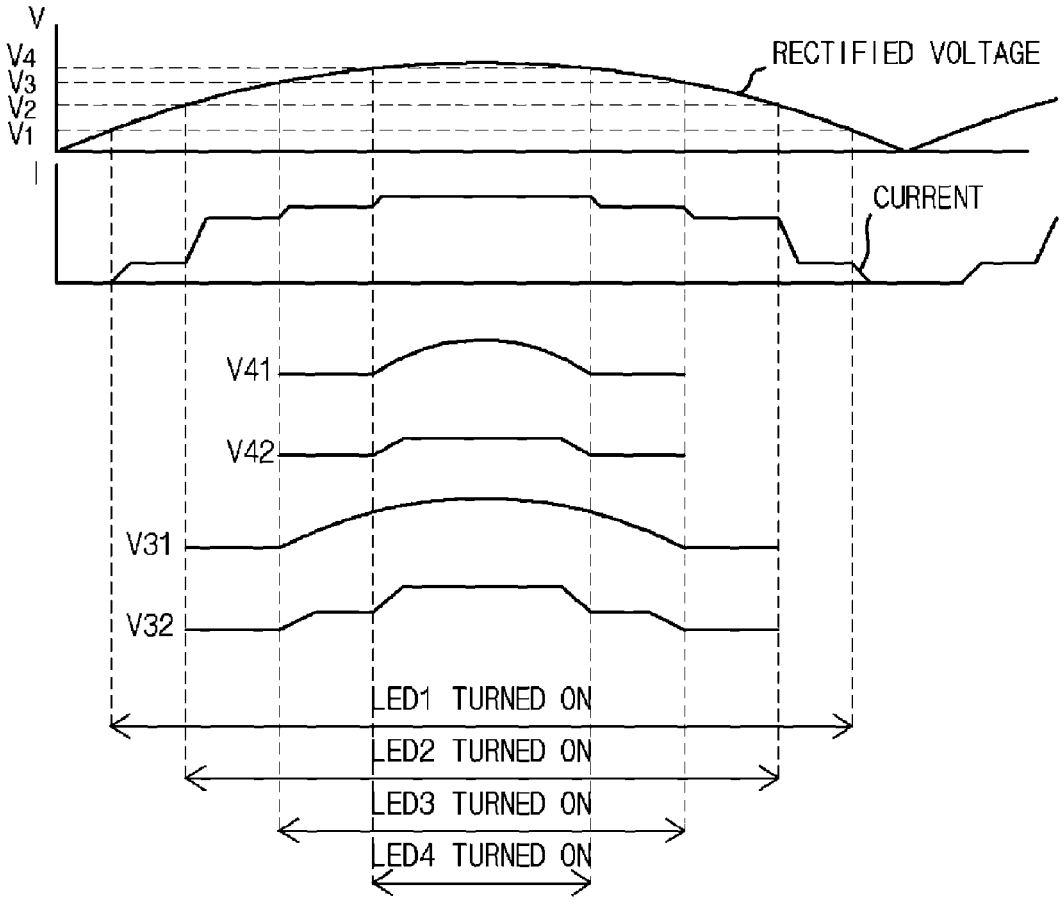
FIG. 4 is a waveform diagram for describing the operation of the embodiment of FIG. 3.

In the embodiment of FIGS. 3 and 4, the surplus voltage buffer circuits 16*a* and 16*b* can prevent an over voltage from being applied to the switching circuits 33 and 34 of the IC chip which forms the current path of the current control circuit 14.

Thus, the surplus voltage caused by the rectified voltage in the over-voltage state can be prevented from being applied to the IC chip including the current control circuit 14, and the surplus voltage included in the rectified voltage in the over-voltage state may be absorbed and buffered outside the IC chip.

The present embodiment may further include surplus voltage buffer circuits for a part or all of the other LED groups excluding the LED groups LED3 and LED4 which already have the surplus voltage buffer circuits. More specifically, surplus voltage buffer circuits may be configured for the LED groups LED4, LED3, and LED2 or the LED groups LED4, LED3, LED2, and LED1. Thus, the control circuit in accordance with the embodiment of the present invention may additionally buffer surplus voltages exceeding the light emission voltages of the LED groups LED2 and LED1 through voltage control. In this case, since the voltage buffering operation is performed in the same manner, the detailed descriptions thereof are omitted herein.

According to the above-described configuration, although an over voltage is caused by the sequential turn-on/off operations of the LED groups or the LED groups are driven at an over voltage higher than a design value due to the power system environment or unstable power characteristic, the control circuit can buffer a surplus voltage included in the over voltage, thereby preventing the heat generation of the current control circuit.

Thus, the control circuit of the LED lighting apparatus can prevent the damage of internal parts due to a malfunction of the control circuit or thermal stress, which is caused by an over voltage. As a result, the lifetime and reliability of products can be improved.

In particular, when the LED lighting apparatus is designed to have a large capacity, the control circuit in accordance with the embodiment of the present invention can effectively prevent heat generated by an AC input voltage higher than the design value of the AC input voltage.

While various embodiments have been described above, it will be understood to those skilled in the art that the embodiments described are by way of example only. Accordingly, the disclosure described herein should not be limited based on the described embodiments.

What is claimed is:

1. A control circuit of an LED lighting apparatus divided into a plurality of LED groups, comprising:

a current control circuit configured to provide a current path corresponding to sequential light emissions of the LED groups in response to a rectified voltage; and surplus voltage buffer circuits corresponding to a first LED group which emits light in response to the highest light emission voltage and a second LED group which emits light in response to the second highest light emission voltage, respectively, and each configured to buffer a surplus voltage higher than the corresponding light emission voltage through voltage control.

2. The control circuit of claim 1, wherein the current control circuit is connected to a sensing resistor for providing a sensing voltage corresponding to a current flow of the current path, and provides the current path in response to the sensing voltage and the changes in light emitting state of the LED groups.

3. The control circuit of claim 1, wherein the current control circuit performs constant current regulation in response to the sequential light emissions of the LED groups.

4. The control circuit of claim 1, wherein the current control circuit provides reference voltages having different levels in response to the light emitting states of the LED groups, compares a sensing voltage corresponding to a current amount on the current path to the reference voltages, and provides the current path corresponding to the changes in light emitting state of the LED groups.

5. The control circuit of claim 1, wherein the surplus voltage buffer circuits are configured outside an integrated circuit (IC) chip including the current control circuit.

6. The control circuit of claim 1, wherein each of the surplus voltage buffer circuits absorbs the surplus voltage exceeding the light emission voltage of the corresponding LED group.

7. The control circuit of claim 1, wherein each of the surplus voltage buffer circuits comprises:

a surplus voltage detection unit configured to provide a detection voltage having a constant voltage period in response to a change of the rectified voltage; and a switching unit configured to control the surplus voltage exceeding the light emission voltage of the corresponding LED group according to the detection voltage, and buffer the surplus voltage transmitted to the current control circuit.

8. The control circuit of claim 7, wherein the surplus voltage detection unit comprises a Zener diode.

9. The control circuit of claim 8, wherein the Zener diode has a breakdown voltage of 3V to 50V.

10. The control circuit of claim 7, wherein the surplus voltage detection unit comprises:

a detection resistor configured to receive the rectified voltage applied to the corresponding LED group; and a Zener diode configured to receive a voltage transmitted through the detection voltage, and the Zener diode serves as a constant voltage source corresponding to the rectified voltage, and provides the detection voltage having the constant voltage period.

11. The control circuit of claim 7, wherein the switching unit comprises a power FET which absorbs the surplus voltage according to the detection voltage.

12. The control circuit of claim 11, wherein the switching unit drops the surplus voltage by increasing a source-drain voltage of the power FET.

13. The control circuit of claim 1, further comprising the surplus voltage buffer circuits provided for a part or all of the other LED groups excluding the first and second LED groups among the plurality of LED groups, and each configured to buffer the surplus voltage higher than the light emission voltage of the corresponding LED group through voltage control.

* * * * *